US011654702B2

(12) United States Patent
Waki et al.

(10) Patent No.: US 11,654,702 B2
(45) Date of Patent: May 23, 2023

(54) RECORDING DEVICE

(71) Applicant: Seiko Epson Corporation, Tokyo (JP)

(72) Inventors: Shingo Waki, Matsumoto (JP); Yuki Komatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/353,018

(22) Filed: Jun. 21, 2021

(65) Prior Publication Data

US 2021/0394534 A1 Dec. 23, 2021

(30) Foreign Application Priority Data

Jun. 22, 2020 (JP) ..... JP2020-106784

(51) Int. Cl.

| | |
|---|---|
| ***B41J 13/00*** | (2006.01) |
| ***B41J 13/02*** | (2006.01) |
| ***B41J 2/01*** | (2006.01) |
| ***B41J 11/04*** | (2006.01) |
| ***B41J 3/60*** | (2006.01) |

(52) U.S. Cl.

CPC ..... *B41J 13/009* (2013.01); *B41J 2/01* (2013.01); *B41J 3/60* (2013.01); *B41J 11/04* (2013.01); *B41J 13/0036* (2013.01); *B41J 13/0045* (2013.01); *B41J 13/025* (2013.01)

(58) Field of Classification Search

CPC .. B41J 13/0036; B41J 13/0045; B41J 13/009; B41J 13/025; B41J 2/01; B41J 11/04; B41J 3/60

See application file for complete search history.

(56) References Cited

U.S. PATENT DOCUMENTS

2014/0063162 A1* 3/2014 Iijima ..... B41J 13/009 271/10.04
2018/0281479 A1* 10/2018 Ito ..... B41J 3/60

FOREIGN PATENT DOCUMENTS

JP 2018-197167 12/2018

* cited by examiner

*Primary Examiner* — Christopher E Mahoney
*Assistant Examiner* — Kendrick X Liu
(74) *Attorney, Agent, or Firm* — Workman Nydegger

(57) ABSTRACT

A recording device includes a recording unit, a first transport path, a second transport path, a first discharge roller pair, a second discharge roller pair, a first driving motor configured to drive the first discharge driving roller, a second driving motor configured to drive the second discharge driving roller, and a movement mechanism capable of moving the second discharge roller pair between a sandwiching state where a second discharge driving roller and a second discharge driven roller sandwich a recording medium, and a separated state where the second discharge driving roller and the second discharge driven roller are separated. In a part of a period in which the recording medium is transported, the second discharge roller pair is in the separated state.

8 Claims, 10 Drawing Sheets

RECORDING DEVICE

The present application is based on and claims priority from JP Application Serial Number 2020-106784, filed Jun. 22, 2020, the disclosure of which is hereby incorporated by reference herein in its entirety.

BACKGROUND

1. Technical Field

The present disclosure relates to a recording device.

2. Related Art

In the related art, as indicated in JP-A-2018-197167, a recording device has been known that includes a recording head configured to perform recording on a transported sheet, a discharge roller pair disposed downstream of the recording head in a first transport direction, and configured to transport the sheet in the first transport direction, and a reverse roller pair disposed downstream of the discharge roller pair in the first transport direction, and configured to be able to transport the sheet in a second transport direction different from the first transport direction.

In the recording device described above, since the discharge roller pair and the reverse roller pair are driven by the same power source, another new sheet cannot be supplied until reverse transport processing of the reverse roller pair ends even after the transport of the sheet by the discharge roller pair ends, for example, and throughput of printing is reduced.

Thus, it is conceivable that the discharge roller pair and the reverse roller pair are configured to be separately driven. With such a configuration, while the sheet is transported in the second transport direction by driving the reverse roller pair in a reverse direction, another new sheet can be transported in the first transport direction by driving the discharge roller pair in a normal direction, and a speed of processing of double-sided printing can be increased.

However, in a case of this configuration, when the discharge roller pair and the reverse roller pair are driven in the normal direction and sandwich the same sheet to perform transport processing, there is a problem in that a variation occurs in transport amount of the sheet unless the discharge roller pair and the reverse roller pair are reliably driven in synchronization, and image quality decreases.

SUMMARY

A recording device includes a recording unit configured to perform recording on a recording medium, a first transport path in which the recording medium is transported in a first direction during recording by the recording unit, a second transport path that is coupled to the first transport path in a position downstream of the recording unit in the first direction, and in which the recording medium on which recording was performed by the recording unit is transported in a second direction different from the first direction in a path different from the first transport path, a first discharge roller pair disposed in a position upstream in the first direction from a coupling position of the first transport path with the second transport path, and configured to sandwich a recording medium on which recording was performed by the recording unit, and transport the recording medium in the first direction, a second discharge roller pair disposed in the coupling position or disposed downstream of the coupling position in the first direction, configured to sandwich the recording medium, and apply a transport force in the first direction to the recording medium in the first transport path and a transport force in the second direction to the recording medium in the second transport path, and formed of a second discharge driving roller and a second discharge driven roller, a first driving motor configured to drive the first discharge driving roller, a second driving motor configured to drive the second discharge driving roller, and a movement mechanism configured to move the second discharge roller pair between a sandwiching state where the second discharge driving roller and the second discharge driven roller sandwich the recording medium, and a separated state where the second discharge driving roller and the second discharge driven roller are separated, wherein the second discharge roller pair is in the separated state in a part of a period in which the recording medium is transported.

DESCRIPTION OF EXEMPLARY EMBODIMENTS

Figure 1:
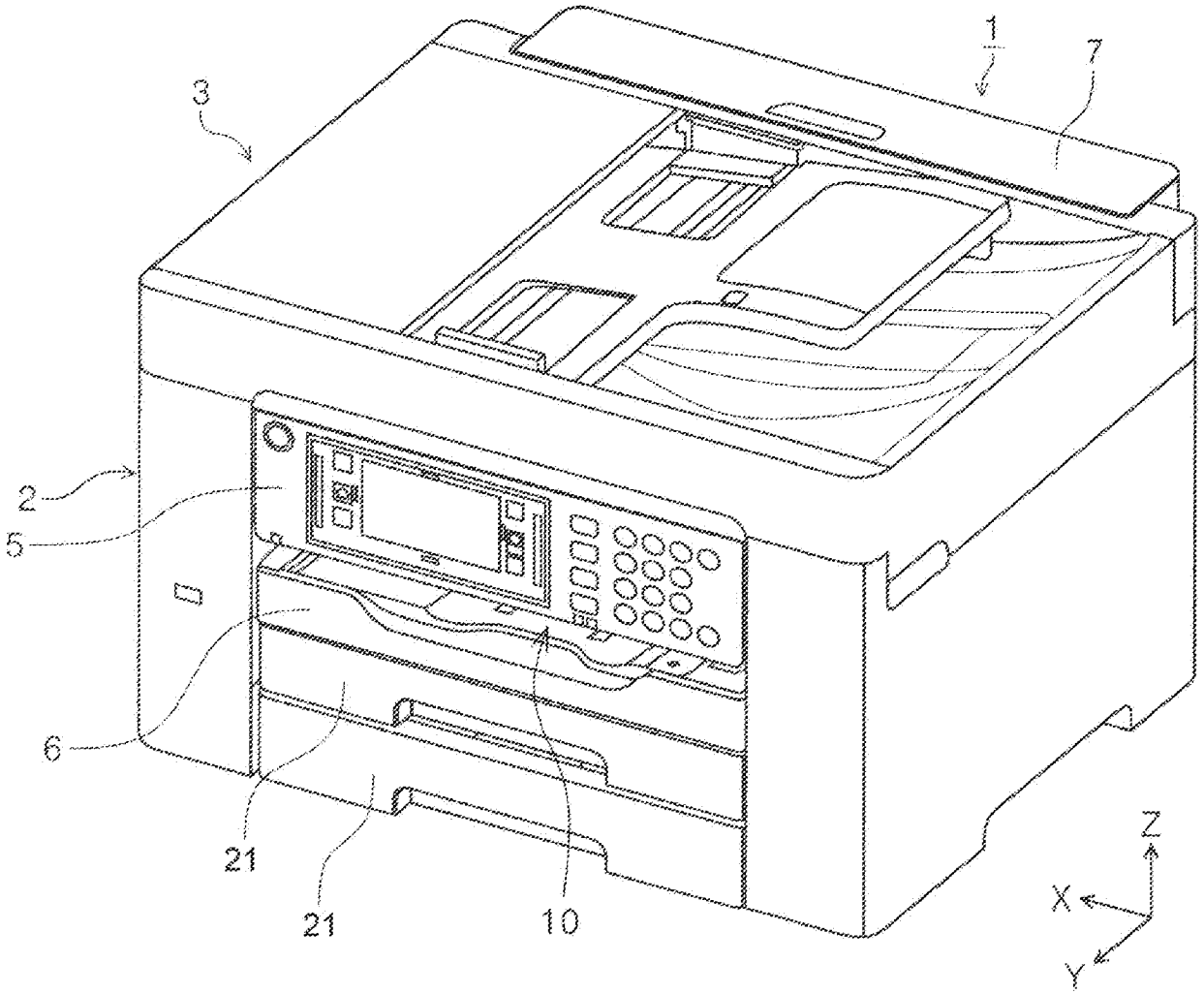
FIG. 1 is an external perspective view illustrating a configuration of a recording device.
Figure 2:
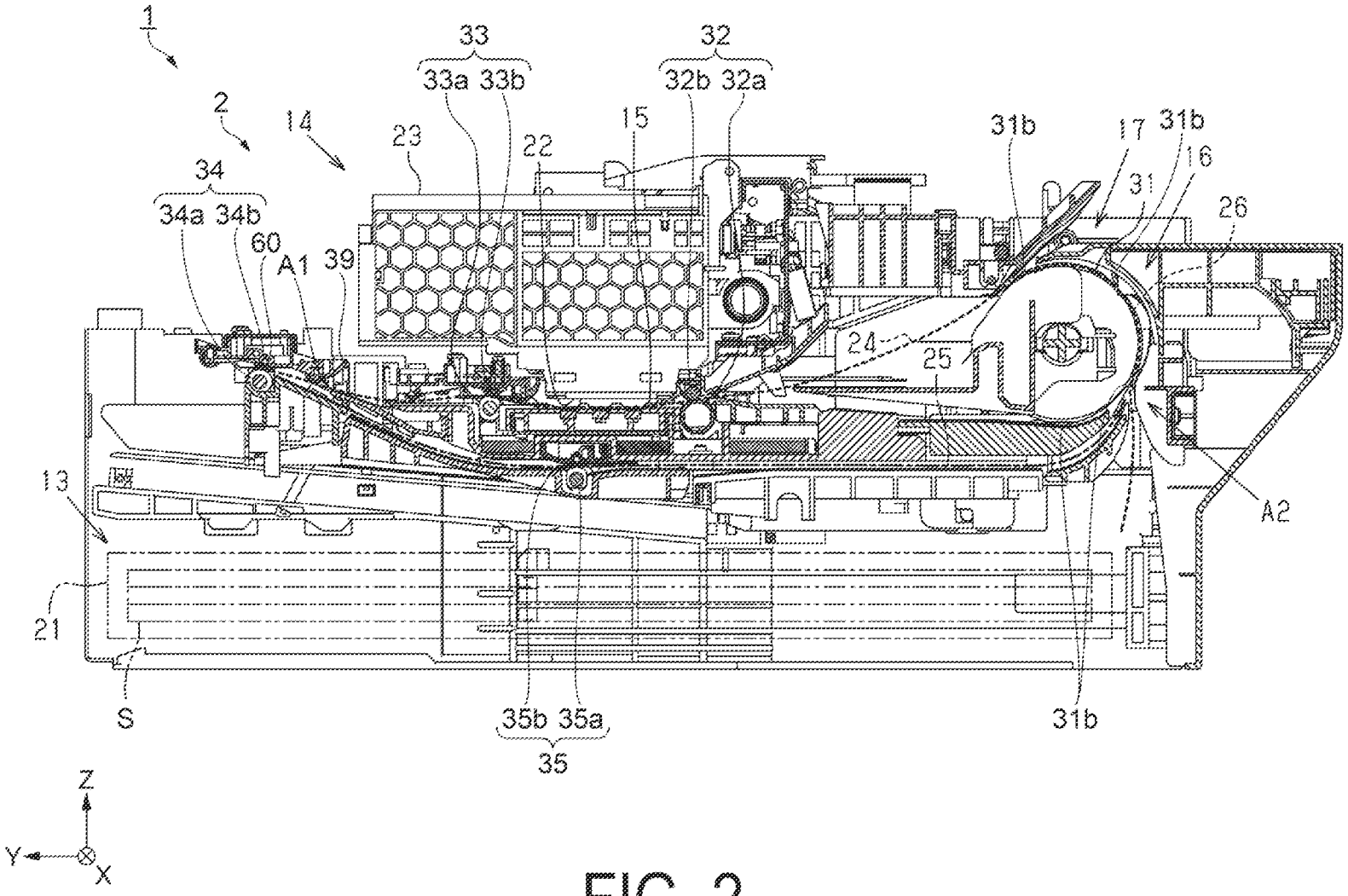
FIG. 2 is a side cross-sectional view illustrating the configuration of the recording device.

A configuration of a recording device 1 will be described. FIG. 1 is an external perspective view illustrating the configuration of the recording device 1, and FIG. 2 is a side cross-sectional view illustrating the configuration of the recording device 1.

As illustrated in FIG. 1, the recording device (for example, an inkjet printer) 1 includes a device main body 2, and a scanner unit 3 provided on an upper portion of the device main body 2. The recording device 1 is a so-called multifunctional machine. The device main body 2 has a recording function of performing recording on a recording medium S (for example, recording paper). The scanner unit 3 has a function of reading a document. The scanner unit 3 includes an automatic document feeding mechanism (ADF: auto document feeder) that automatically feeds a set document.

The device main body 2 includes a transport unit 17 that transports the recording paper, a recording unit 14 being an example of a recoding means, and the like. Further, a cassette 21 that accommodates the recording medium S is provided. In the present embodiment, two cassettes 21 are provided.

The device main body 2 includes a cover 7 that opens and closes, and is configured to be able to set and feed the recording medium S with the cover 7 in an open state.

The device main body 2 includes an operation unit 5 that performs various operations of the recording device 1 on a front face (surface in a +Y direction) of the device. The operation unit 5 includes a display unit and a plurality of operation buttons, and is provided so as to be able to be tilted.

A discharge port 10 through which the recording medium S on which recording is performed is discharged is provided on a lower side of the operation unit 5, and a discharge tray 6 that receives the discharged recording medium S is provided on the lower side of the discharge port 10. The discharge tray 6 is provided such that the discharge tray 6 can be in a state of being accommodated inside the device main body 2 and a state of being pulled out from the device main body 2.

As illustrated in FIG. 2, the device main body 2 includes an accommodation portion 13, the recording unit 14, a support portion 15, a transport path 16, the transport unit 17, and the like.

The accommodation portion 13 is configured so as to accommodate the recording medium S. The accommodation portion 13 according to the present embodiment is configured so as to be able to accommodate the cassette 21 that accommodates the recording medium S. The cassette 21 is configured to be detachable from the device main body 2. The recording device 1 includes a supply mechanism (not illustrated) capable of supplying the recording medium S accommodated in the accommodation portion 13 toward the recording unit 14. Note that, in FIG. 2, a part of the cassette 21 is omitted.

The recording unit 14 is configured so as to perform recording on the recording medium S. The recording unit 14 includes a head 22 and a carriage 23. The head 22 discharges liquid toward the recording medium S. The carriage 23 is equipped with the head 22, and scans the recording medium S in a direction along an X axis. In other words, the recording device 1 according to the present embodiment is a serial type printer. Note that the recording device 1 may be a line type printer capable of performing recording all at once in a width direction (the direction along the X axis) of the recording medium S. The recording unit 14 performs recording on the recording medium S from above.

The support portion 15 faces the recording unit 14. The support portion 15 supports the recording medium S supplied from the accommodation portion 13. The support portion 15 supports a portion of the recording medium S recorded by the recording unit 14. The support portion 15 supports the recording medium S from below.

The transport path 16 is a path in which the recording medium S is transported. The transport path 16 includes a first transport path 24 and a second transport path 25. In FIG. 2, a path indicated by a dashed line is the first transport path 24, and a path indicated by a dot-dash line is the second transport path 25.

The first transport path 24 includes a path in which the recording medium S is transported in a direction corresponding to the +Y direction as a first direction during recording by the recording unit 14. The first transport path 24 extends from the accommodation portion 13 via the recording unit 14. The first transport path 24 according to the present embodiment extends between the recording unit 14 and the support portion 15. Thus, the recording medium S is recorded by the recording unit 14 while being transported in the first transport path 24. In other words, the recording unit 14 performs recording on the recording medium S in the first transport path 24. The recorded recording medium S is discharged to the outside of the device main body 2 by being transported in the first transport path 24.

The first transport path 24 according to the present embodiment extends upward from the accommodation portion 13, and then extends forward (+Y direction) toward the recording unit 14. Thus, the first transport path 24 according to the present embodiment includes a curved portion 26 being curved. The curved portion 26 is located between the accommodation portion 13 and the recording unit 14 in the first transport path 24. The recording medium S is transported through the curved portion 26, and thus a posture of the recording medium S is vertically reversed when being accommodated in the accommodation portion 13 and when facing the recording unit 14.

The second transport path 25 is a path that is coupled to the first transport path 24 in a position downstream of the recording unit 14, and in which the recording medium S recorded by the recording unit 14 is transported in a direction corresponding to a −Y direction as a second direction different from the direction corresponding to the +Y direction in a path different from the first transport path 24. Specifically, the second transport path 25 branches in a branch position A1 (coupling position) from the first transport path 24. The second transport path 25 according to the present embodiment branches downstream of the recording unit 14 in the first transport path 24. In other words, the branch position A1 of the first transport path 24 and the second transport path 25 is located downstream of the recording unit 14 in the first transport path 24. A flap 39 is provided upstream of the branch position A1. When the recording medium S is transported into the second transport path 25, the recording medium S is fed into the second transport path 25 by raising an end portion in the +Y direction of the flap 39 upward. Note that the flap 39 is driven by a flap drive source (not illustrated) controlled by a control unit 100 (see FIG. 4).

The second transport path 25 and the first transport path 24 merge in a merging position A2 upstream of the recording unit 14. In other words, the merging position A2 of the first transport path 24 and the second transport path 25 is located upstream of the recording unit 14 in the first transport path 24. More specifically, the merging position A2 is located upstream of the curved portion 26 in the first transport path 24.

The second transport path 25 extends from the branch position A1 toward the merging position A2. The second transport path 25 according to the present embodiment extends below the first transport path 24. When recording is performed on both sides (in a case of double-sided printing), the recording medium S is transported to the second transport path 25.

The transport unit 17 is configured so as to transport the recording medium S along the transport path 16. The transport unit 17 according to the present embodiment includes a first transport roller 31, a second transport roller pair 32, a first discharge roller pair 33, a second discharge roller pair 34, and a relay roller pair 35. The first transport roller 31, the second transport roller pair 32, the first discharge roller pair 33, the second discharge roller pair 34, and the relay roller pair 35 rotate to apply a transport force to the recording medium S, and the recording medium S is transported.

The first transport roller 31, the second transport roller pair 32, the first discharge roller pair 33, and the second discharge roller pair 34 are located along the first transport path 24. The first transport roller 31, the second transport roller pair 32, the first discharge roller pair 33, and the second discharge roller pair 34 are located in this order from upstream to downstream in the first transport path 24.

The first transport roller 31 is located upstream of the recording unit 14 in the first transport path 24. Specifically, the first transport roller 31 is located between the recording unit 14 and the merging position A2 in the first transport path 24. The first transport roller 31 transports the recording medium S supplied from the accommodation portion 13 and the recording medium S transported in the second transport path 25. A circumferential surface of the first transport roller 31 is located along the curved portion 26 in the first transport path 24. Thus, the curved portion 26 in the first transport path 24 is a portion extending along the circumferential surface of the first transport roller 31. A plurality of driven rollers 31*b* are disposed on the circumferential surface of the first transport roller 31, and a transport force is applied to the recording medium S by sandwiching the recording medium S between the first transport roller 31 and the driven roller 31*b*.

The second transport roller pair 32 is located upstream of the recording unit 14 in the first transport path 24. The second transport roller pair 32 is located between the recording unit 14 and the first transport roller 31 in the first transport path 24. The second transport roller pair 32 transports the recording medium S transported by the first transport roller 31 to the recording unit 14 side. The second transport roller pair 32 is formed of a second transport driving roller 32*a* that is driven in rotation, and a second transport driven roller 32*b* that is driven by rotation. A transport force is applied to the recording medium S by sandwiching the recording medium S between the second transport driving roller 32*a* and the second transport driven roller 32*b*.

The first discharge roller pair 33 is located downstream of the recording unit 14 in the first transport path 24. Specifically, the first discharge roller pair 33 is located between the recording unit 14 and the branch position A1 in the first transport path 24. The first discharge roller pair 33 transports, to the downstream side, the recording medium S transported by the second transport roller pair 32. The first discharge roller pair 33 is formed of a first discharge driven roller 33*a* that is driven in rotation, and a first discharge driven roller 33*b* that is driven by rotation. A transport force is applied to the recording medium S by sandwiching the recording medium S between the first discharge driving roller 33*a* and the first discharge driven roller 33*b*.

The second discharge roller pair 34 is disposed in the branch position A1 downstream of the first discharge roller pair 33 or disposed downstream of the branch position A1. In the present embodiment, the second discharge roller pair 34 is disposed downstream of the branch position A1. The second discharge roller pair 34 is formed of a second discharge driving roller 34*a* that is driven in rotation, and a second discharge driven roller 34*b* that is driven by rotation. A transport force is applied to the recording medium S by sandwiching the recording medium S between the second discharge driving roller 34*a* and the second discharge driven roller 34*b*. The second discharge driven roller 34*b* is, for example, a spurred jagged roller.

The second discharge roller pair 34 is configured to sandwich the recording medium S, and be able to apply a transport force in the direction corresponding to the +Y direction to the recording medium S in the first transport path 24, and a transport force in the direction corresponding to the −Y direction to the recording medium S in the second transport path 25.

Specifically, the second discharge driving roller 34*a* is configured so as to rotate in both directions of a normal direction and a reverse direction. When the second discharge roller pair 34 transports the recording medium S in the direction corresponding to the +Y direction from upstream to downstream in the first transport path 24, the second discharge driving roller 34*a* rotates in the normal direction. On the other hand, when the transport direction of the recording medium S transported downstream of the first transport path 24 is reversed and the recording medium S is transported in the direction corresponding to the −Y direction in the second transport path 25, the second discharge driving roller 34*a* rotates in the reverse direction. Note that a counterclockwise direction in FIG. 2 is the normal direction, and a clockwise direction is the reverse direction.

The relay roller pair 35 is located midway along the second transport path 25. The relay roller pair 35 transports the recording medium S along the second transport path 25 in the direction corresponding to the −Y direction. In other words, the relay roller pair 35 transports the recording medium S from the branch position A1 toward the merging position A2 in the second transport path 25. The relay roller pair 35 is formed of a relay driving roller 35*a* that is driven in rotation, and a relay driven roller 35*b* that is driven by rotation. A transport force is applied to the recording medium S by sandwiching the recording medium S between the relay driving roller 35*a* and the relay driven roller 35*b*.

In recording (double-sided printing) on both sides of the recording medium S using the first transport path 24 and the second transport path 25, when recording is performed on a second surface on an opposite side to a first surface of the recording medium S having the first surface being recorded, after recording on the first surface is completed, an upstream end in the transport direction of the recording medium S is transported to the branch position A1 exceeding a tip portion in the +Y direction of the flap 39 in the direction corresponding to the +Y direction in the first transport path 24, and is then reversed at the second discharge driving roller 34*a*. In this way, the recording medium S is fed into the second transport path 25. The recording medium S fed into the second transport path 25 is transported to the merging position A2, has a surface of the recording medium S reversed by the first transport roller 31, and is transported such that second surface faces the head 22. In this way, the liquid is discharged from the head 22 onto the second surface, and double-sided printing of the recording medium S is performed.

In the recording device 1 according to the present embodiment, the first discharge driving roller 33*a* and the second discharge driving roller 34*a* are driven by power sources different from each other.

Figure 4:
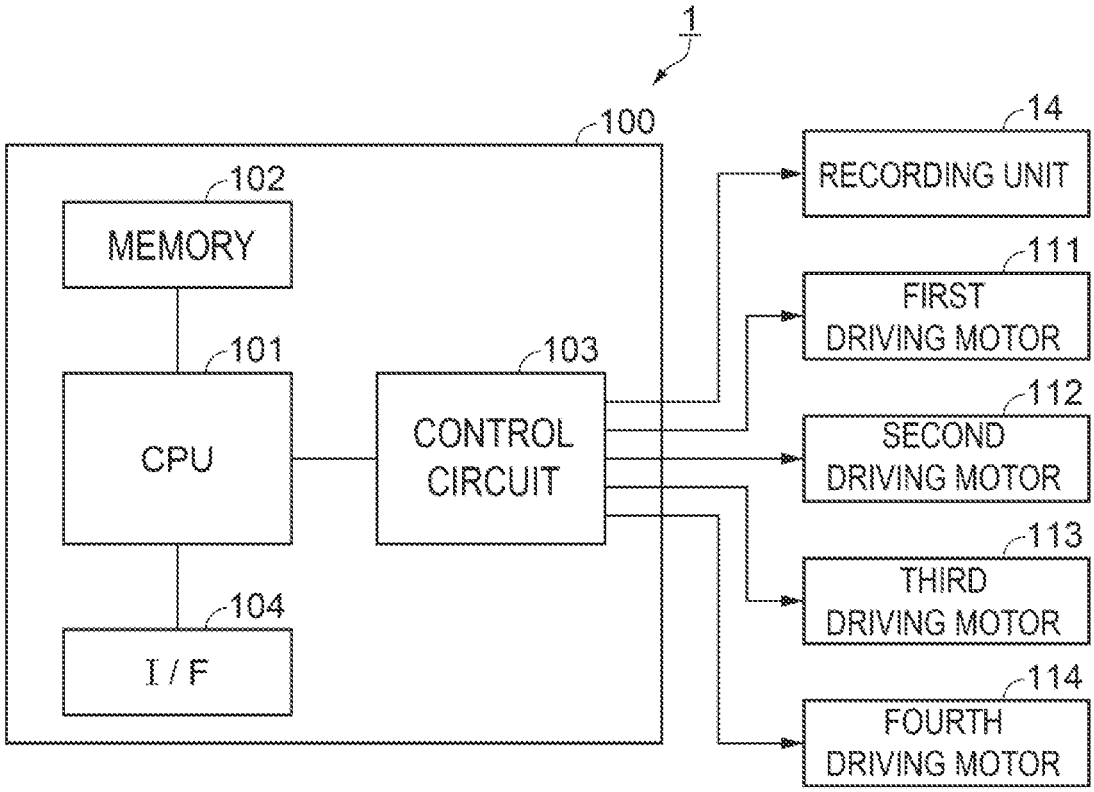
FIG. 4 is a block diagram illustrating a configuration of a control unit.

Specifically, the first discharge driving roller 33*a* is driven by a first driving motor 111, and the second discharge driving roller 34*a* is driven by a second driving motor 112 (see FIG. 4).

More specifically, the first discharge driving roller 33*a* and the second transport driving roller 32*a* are driven by the first driving motor 111, and the second discharge driving roller 34*a* and the relay driving roller 35*a* are driven by the second driving motor 112. The first transport roller 31 is driven by a fourth driving motor 114.

The first discharge driving roller 33*a* and the second discharge driving roller 34*a* are driven by different power sources, and thus the first discharge driving roller 33*a* can be rotated in the normal direction to transport the recording medium S along the first transport path 24, and the second discharge driving roller 34*a* can also be rotated in the reverse direction to transport the previously recorded recording medium S along the second transport path 25. In other words, the first discharge driving roller 33*a* and the second discharge driving roller 34*a* are separately driven, and thus a speed of processing of the double-sided printing can be increased.

However, when the first discharge roller pair 33 and the second discharge roller pair 34 transport the same recording medium S along the first transport path 24 while sandwiching the recording medium S, there is a problem in that a variation occurs in transport amount of the recording medium S unless the first discharge roller pair 33 and the second discharge roller pair 34 are reliably driven in synchronization, and image quality decreases.

Specifically, in a state where the same recording medium S in the first transport path 24 is sandwiched between the second transport roller pair 32, the first discharge roller pair 33, and the second discharge roller pair 34, a transport force of the second transport roller pair 32 to the recording medium S is set higher than a transport force of the other first discharge roller pair 33 and second discharge roller pair 34 to the recording medium S, and thus the transport force of the second transport roller pair 32 becomes dominant, and the recording medium S can be sequentially transported downstream. In other words, in this state, the state of synchronization between the first discharge roller pair 33 and the second discharge roller pair 34 does not affect a transport property of the recording medium S, and the image quality is secured.

On the other hand, in a state where the recording medium S is further transported and the same recording medium S is sandwiched between the first discharge roller pair 33 and the second discharge roller pair 34, the image quality is affected by the synchronization state of the first discharge roller pair 33 and the second discharge roller pair 34. For example, when a transport speed of the recording medium S by the second discharge roller pair 34 is slower than a transport speed by the first discharge roller pair 33, a transport amount of the recording medium S is smaller than a theoretical transport amount. Further, when a transport speed of the recording medium S by the second discharge roller pair 34 is faster than a transport speed by the first discharge roller pair 33, a transport amount of the recording medium S is greater than the theoretical transport amount. Thus, when a variation occurs in transport amount of the recording medium S during recording processing by the recording unit 14, the image quality decreases.

Thus, the recording device 1 according to the present embodiment includes a movement mechanism 60 capable of moving the second discharge roller pair 34 between a sandwiching state where the second discharge driving roller 34*a* and the second discharge driven roller 34*b* sandwich the recording medium S, and a separated state where the second discharge driving roller 34*a* and the second discharge driven roller 34*b* are separated. Then, in a part of a period, the second discharge roller pair 34 is configured to be movable into the separated state. In this way, for example, during the transport of the recording medium S, the second discharge roller pair 34 is movable into the separated state in a part of a period in which the image quality is considered to be affected. In this way, the first discharge roller pair 33 and the second discharge roller pair 34 do not interfere with each other in the transport of the recording medium S. In other words, synchronization is disabled. Therefore, a transport failure of the recording medium S can be reduced, and the image quality can be improved.

Next, a configuration of the movement mechanism 60 will be described.

Figure 3A:
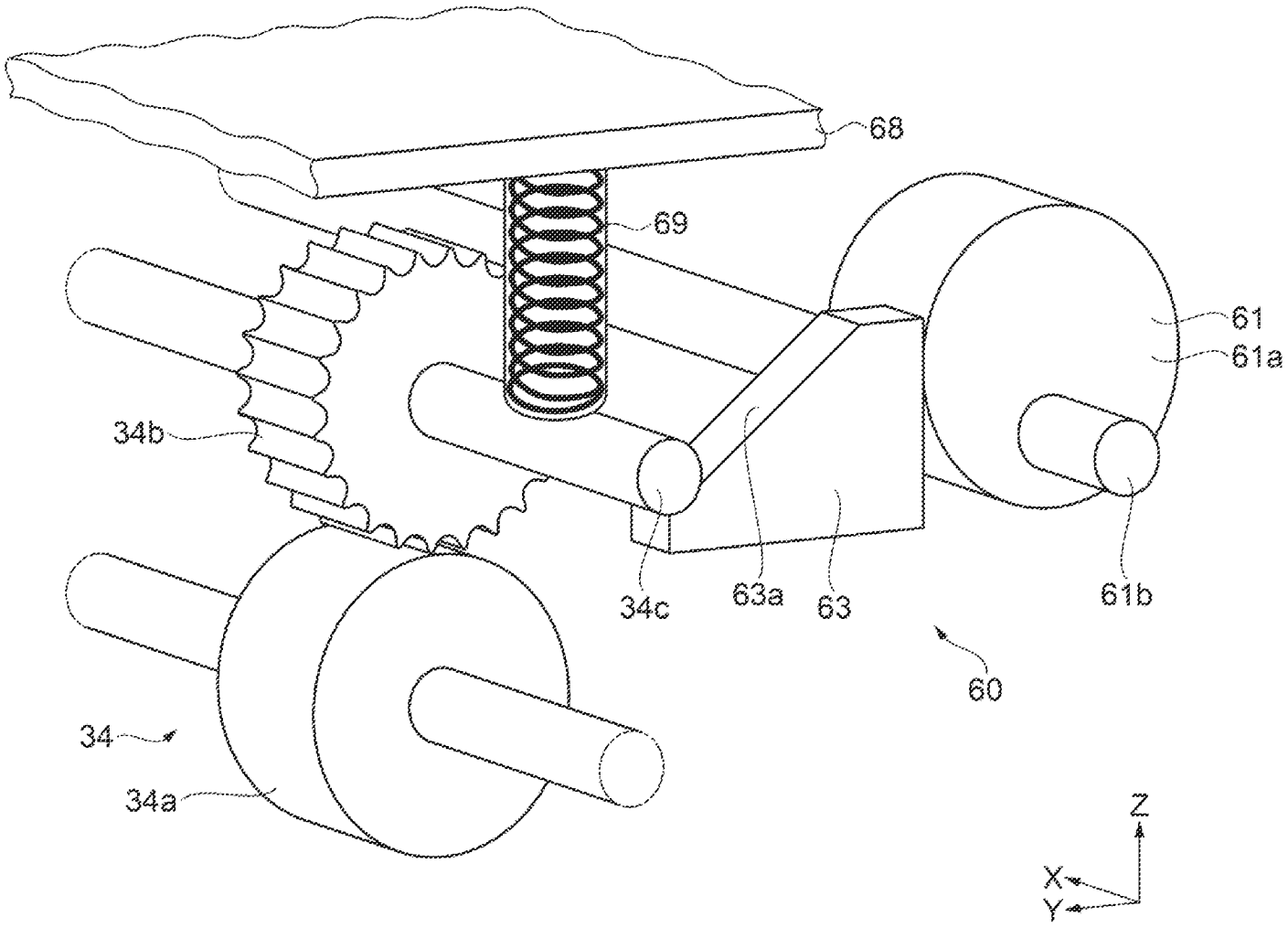
FIG. 3A is a perspective view illustrating a configuration of a movement mechanism.
Figure 3B:
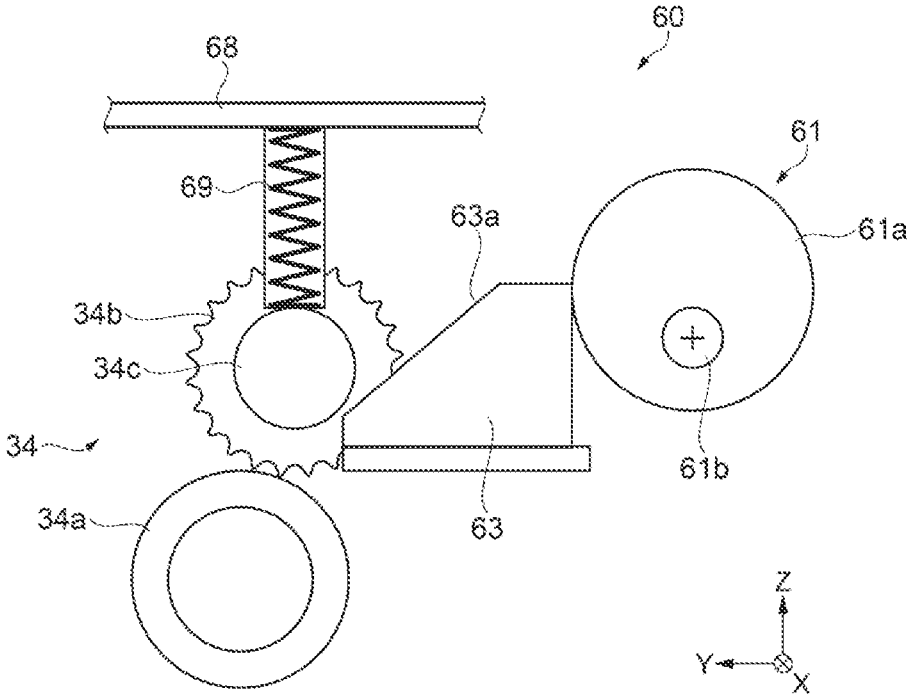
FIG. 3B is a schematic view illustrating an operation of the movement mechanism.
Figure 3C:
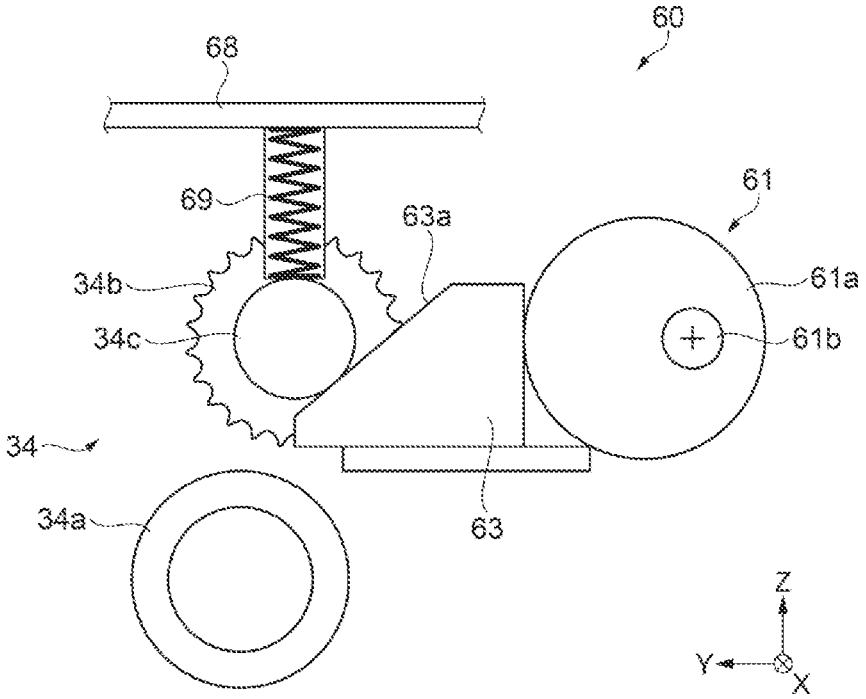
FIG. 3C is a schematic view illustrating an operation of the movement mechanism.

FIG. 3A is a perspective view illustrating a configuration of the movement mechanism 60. FIGS. 3B and 3C are schematic views each illustrating an operation of the movement mechanism 60. FIG. 3B illustrates a sandwiching state of the second discharge roller pair 34. FIG. 3C illustrates a separated state of the second discharge roller pair 34.

As illustrated in FIG. 3A, the movement mechanism 60 includes an eccentric cam 61, and a slide cam 63 that interlocks with the eccentric cam 61.

The eccentric cam 61 includes a cylindrical portion 61*a* having a cylindrical shape, and a rotary shaft 61*b* provided in a position shifted from a center point of the cylindrical portion 61*a* in a side view. By rotating the rotary shaft 61*b*, an outer peripheral surface of the cylindrical portion 61*a* eccentrically moves about the rotary shaft 61*b*. The rotary shaft 61*b* is driven in rotation by a third driving motor 113 (see FIG. 4) as a driving motor.

The outer peripheral surface of the cylindrical portion 61*a* is held in contact with the slide cam 63. The slide cam 63 is biased toward the cylindrical portion 61*a* by a spring (not illustrated).

Then, the slide cam 63 is movable in the direction along the Y-axis by the eccentric movement of the eccentric cam 61.

A part of the slide cam 63 is provided with an inclined surface 63*a*. The surface 63*a* is configured to be able to contact a rotary shaft 34*c* of the second discharge driven roller 34*b* as the slide cam 63 moves in the direction along the Y-axis. Note that the rotary shaft 34*c* of the second discharge driven roller 34*b* is biased in a −Z direction by a compression spring 69 installed on a top plate 68 provided above the second discharge driven roller 34*b*.

Then, the slide cam 63 moves in the +Y direction, and the surface 63*a* of the slide cam 63 slidably moves in contact with the rotary shaft 34*c* of the second discharge driven roller 34*b*, and thus, as illustrated in FIG. 3C, the second discharge driven roller 34*b* enters the separated state of being separated from the second discharge driving roller 34*a*. In the separated state, the second discharge driven roller 34*b* and the second discharge driving roller 34*a* are in a state of being separated by, for example, 1 mm to several mm.

On the other hand, the slide cam 63 moves in the −Y direction, and thus the surface 63*a* of the slide cam 63 is separated from the rotary shaft 34*c*. Thus, as illustrated in FIG. 3B, the second discharge driven roller 34*b* contacts the second discharge driving roller 34*a* and enters the sandwiching state. The movement mechanism 60 is disposed on both ends of the rotary shaft 34*c* extending in a direction along the X-axis, for example.

In this way, the movement mechanism 60 can achieve the sandwiching sate and the separated state with a relatively easy structure.

Note that the eccentric cam 61 may have a configuration in which a solenoid is used instead of the third driving motor 114. Furthermore, the eccentric cam 61 may be configured to vertically move the rotary shaft 34*c* by a solenoid.

Next, a configuration of the control unit 100 of the recording device 1 will be described. FIG. 4 is a block diagram illustrating the configuration of the control unit 100 of the recording device 1.

As illustrated in FIG. 4, the control unit 100 includes a CPU 101, a memory 102, a control circuit 103, and an I/F (interface) 104. The CPU 101 is an arithmetic processing device. The memory 102 is a storage device that secures a region for storing a program of the CPU 101, a working region, or the like, and includes a storage element such as a RAM and an EEPROM. When a print job is acquired from the outside via the I/F 104, the CPU 101 controls, via the control circuit 103, the recording unit 14, the first driving motor 111 (the second transport driving roller 32*a* and the first discharge driving roller 33*a*), the second driving motor 112 (the second discharge driving roller 34*a* and the relay driving roller 35*a*), the third driving motor 113 (the eccentric cam 61), and the fourth driving motor 114 (the first transport roller 31) according to a program stored in the memory 102.

In the present embodiment, the control unit 100 causes the second discharge roller pair 34 to be in the separated state in a part of a period with, as the part of period, a period in which recording is performed on the recording medium S by the recording unit 14. For example, the control unit 100 recognizes, as a part of a period, a processing period by the recording unit 14 included in a print job, and performs control. In this way, during the recording processing on the recording medium S by the recording unit 14, the second transport roller pair 32 and the first discharge roller pair 33 transports the recording medium S. In other words, during the recording processing on the recording medium S, the second discharge roller pair 34 does not take part in the transport of the recording medium S. In this way, a transport failure of the recording medium S during the recording processing can be reduced, and the image quality can be improved.

Furthermore, the control unit 100 moves the second discharge roller pair 34 from the separated state to the sandwiching state after the recording processing on the recording medium S by the recording unit 14 ends. At this time, the second discharge driving roller 34*a* is rotated in the normal direction. In this way, the second discharge roller pair 34 sandwiches the recording medium S, and applies a transport force in the direction corresponding to the +Y direction.

Further, in a case of double-sided printing, the control unit 100 rotates the second discharge driving roller 34*a* in the reverse direction when the upstream end in the transport direction of the recording medium S exceeds the branch position A1. The determination of whether the branch position A1 is exceeded is performed on the basis of, for example, a detection result from a sensor that detects presence or absence of the recording medium S on the downstream side of the branch position A1. In this way, a transport force in the direction corresponding to the −Y direction along the second transport path 25 is applied to the recording medium S. In other words, the second discharge roller pair 34 is in the sandwiching state in a period that does not affect the image quality in the transport of the recording medium S, and can reliably transport the recording medium S.

Next, a control method of the recording device 1 will be described. Specifically, a control method of the first discharge roller pair 33 and the second discharge roller pair 34 in double-sided printing processing will be described.

FIGS. 5A to 5E are schematic views each illustrating the control method of the recording device 1.

Figure 5A:
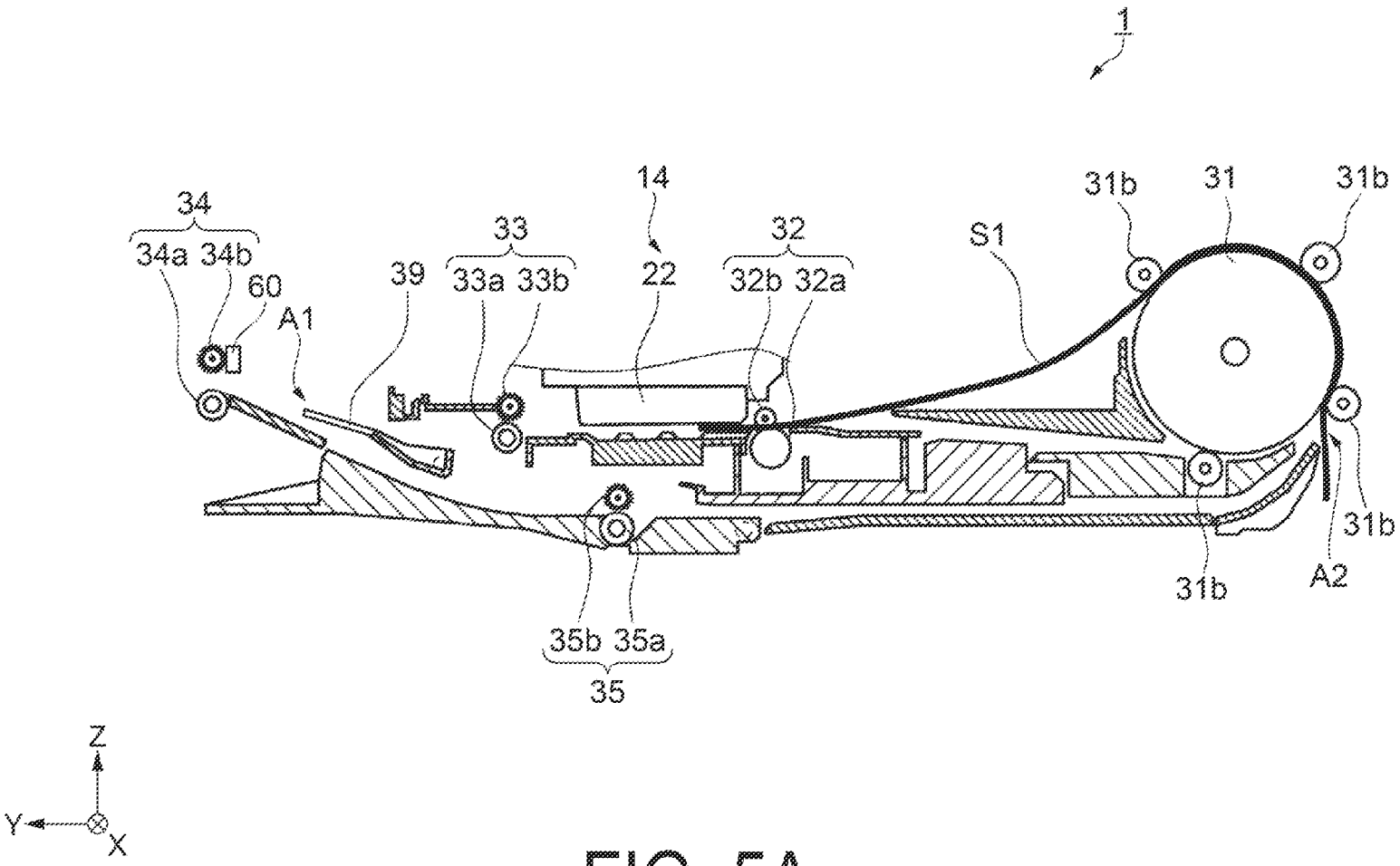
FIG. 5A is a schematic view illustrating a control method of the recording device.

As illustrated in FIG. 5A, when the control unit 100 acquires a print job, the control unit 100 transports a recording medium S1 (S) along the first transport path 24. Then, recording processing is performed by the recording unit 14.

When the recording processing by the recording unit 14 starts, the movement mechanism 60 is driven, and the second discharge roller pair 34 is moved into the separated state.

Figure 5B:
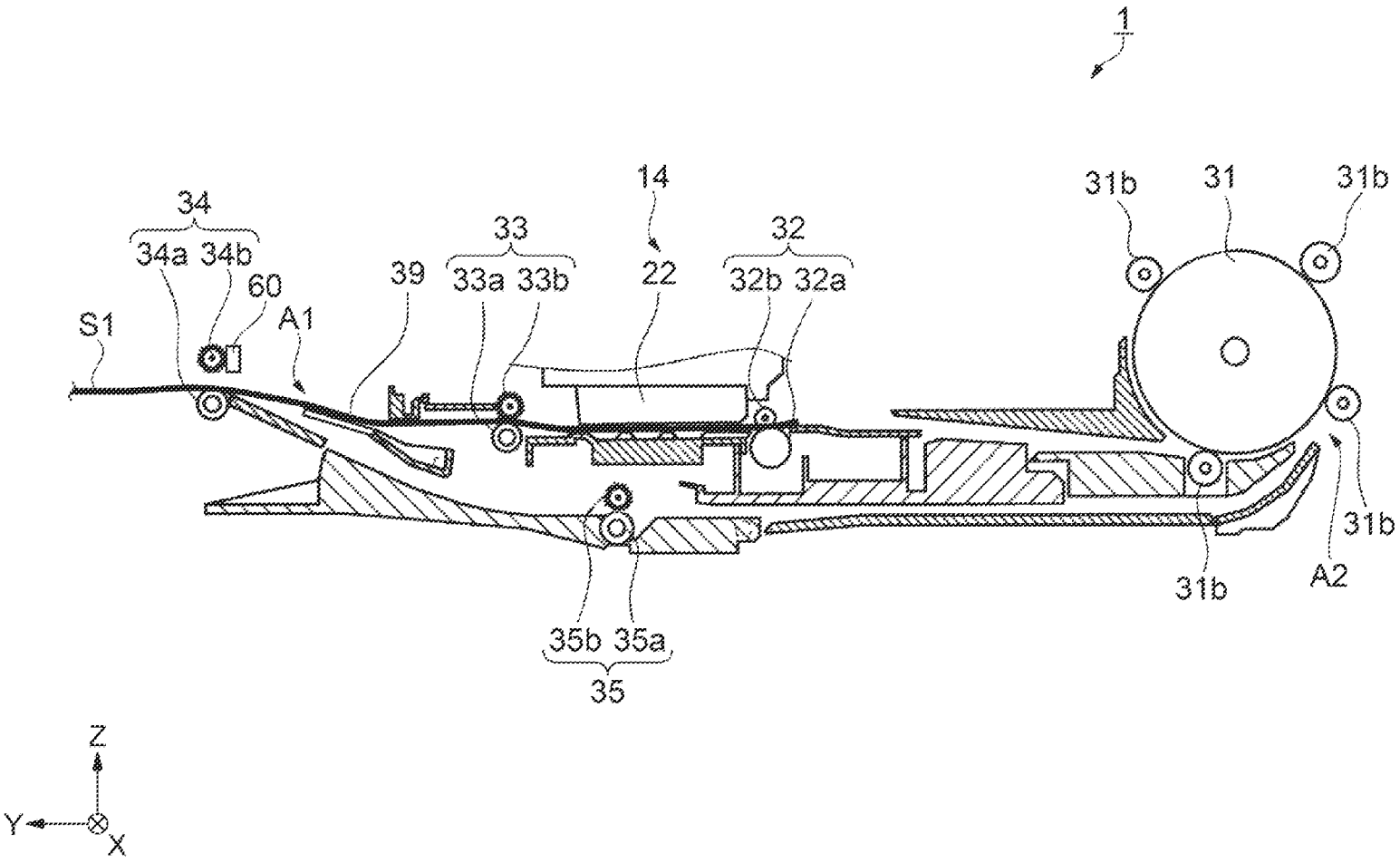
FIG. 5B is a schematic view illustrating the control method of the recording device.

Next, as illustrated in FIG. 5B, the recording medium S1 is further transported downstream while recording is performed. In a recording processing period (a part of a period) by the recording unit 14, the second discharge roller pair 34 is in the separated state, and the recording medium S1 passes between the second discharge driving roller 34*a* and the second discharge driven roller 34*b*. Note that, even when the second discharge roller pair 34 is in the separated state, the second discharge driving roller 34*a* is driven in rotation in the normal direction. The reason is to reduce a transport load on the recording medium S1 when the second discharge roller pair 34 moves from the separated state to the sandwiching state.

Figure 5C:
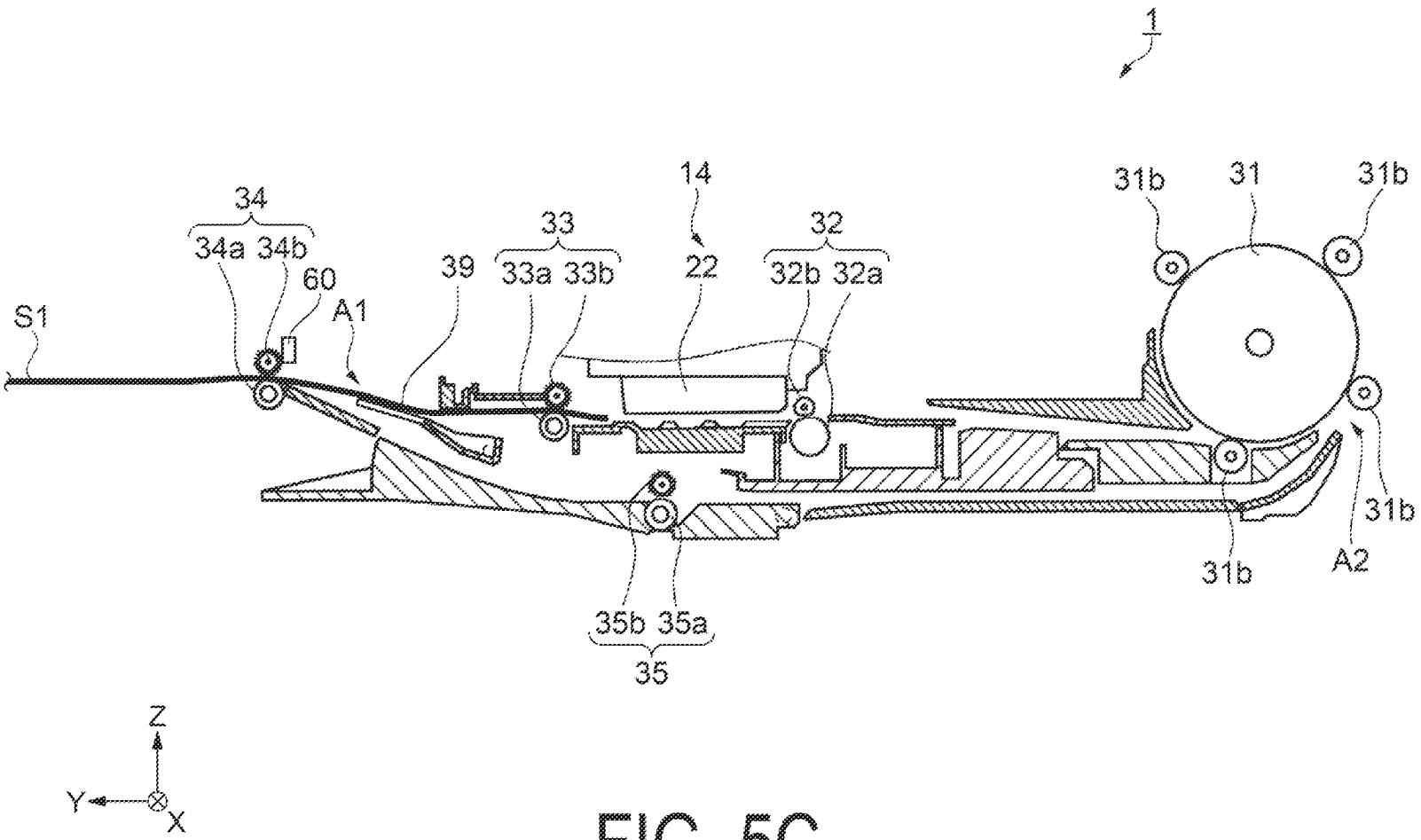
FIG. 5C is a schematic view illustrating the control method of the recording device.

Next, as illustrated in FIG. 5C, when the processing period (the part of the period) by the recording unit 14 included in the print job ends, the control unit 100 moves the second discharge roller pair 34 from the separated state to the sandwiching state.

In this way, the first discharge roller pair 33 and the second discharge roller pair 34 transport the recording medium S1 downstream.

Figure 5D:
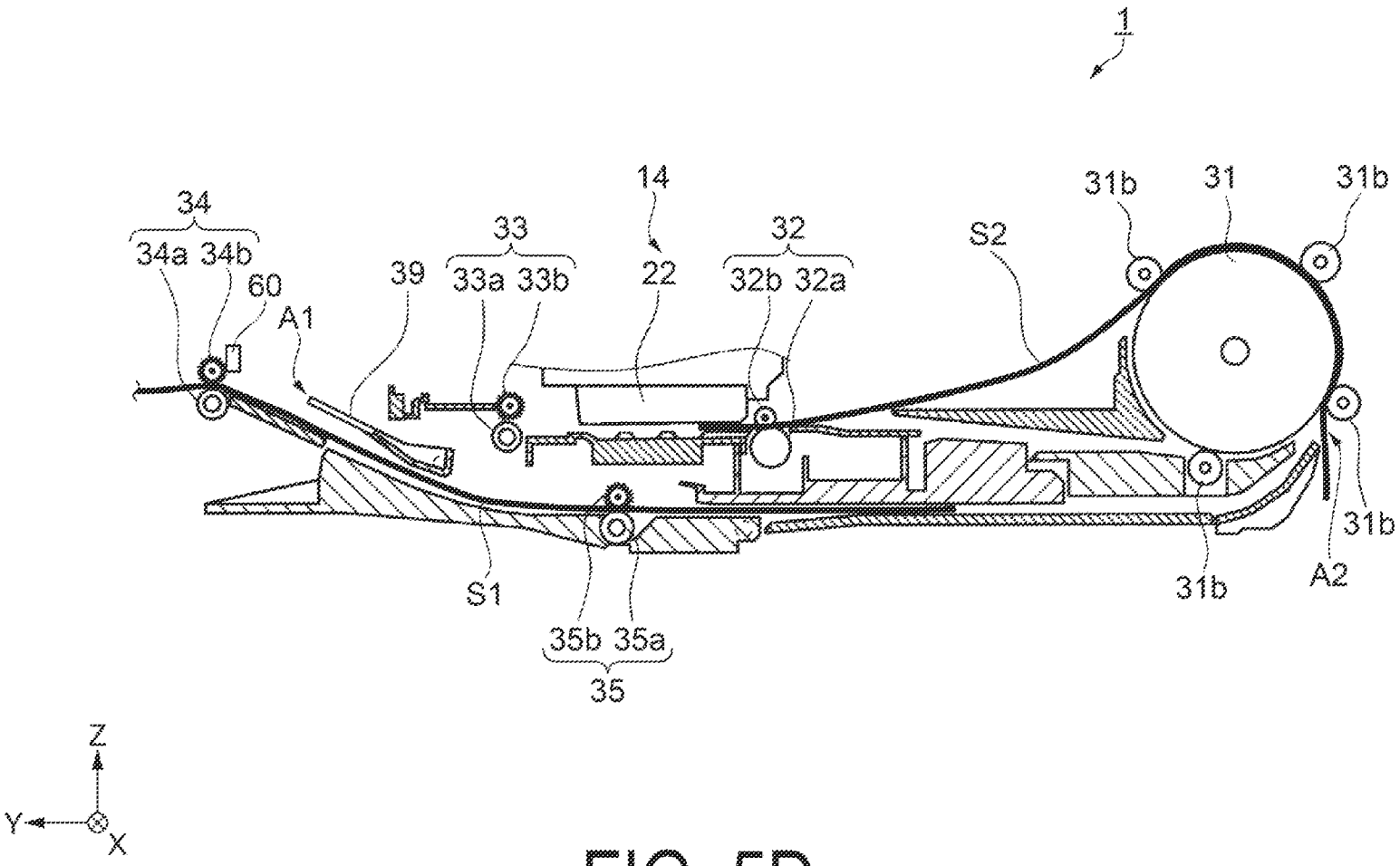
FIG. 5D is a schematic view illustrating the control method of the recording device.

Next, as illustrated in FIG. 5D, when the control unit 100 determines that an upstream end in the transport direction of the recording medium S1 exceeds the branch position A1, the control unit 100 rotates the second discharge driving roller 34*a* in the reverse direction. The recording medium S1 is drawn into the second transport path 25 and transported in the direction corresponding to the −Y direction.

Further, the control unit 100 transports a new recording medium S2 (second recording medium) along the first transport path 24 on the basis of a next print job. Then, the recording processing is performed by the recording unit 14.

When the control unit 100 performs transport driving on the recording medium S1 to the second transport path 25 in the second discharge roller pair 34, the control unit 100 prioritizes the transport driving of the recording medium S1 even at timing at which the recording processing on the new recording medium S2 starts. In other words, the sandwiching state is held.

Figure 5E:
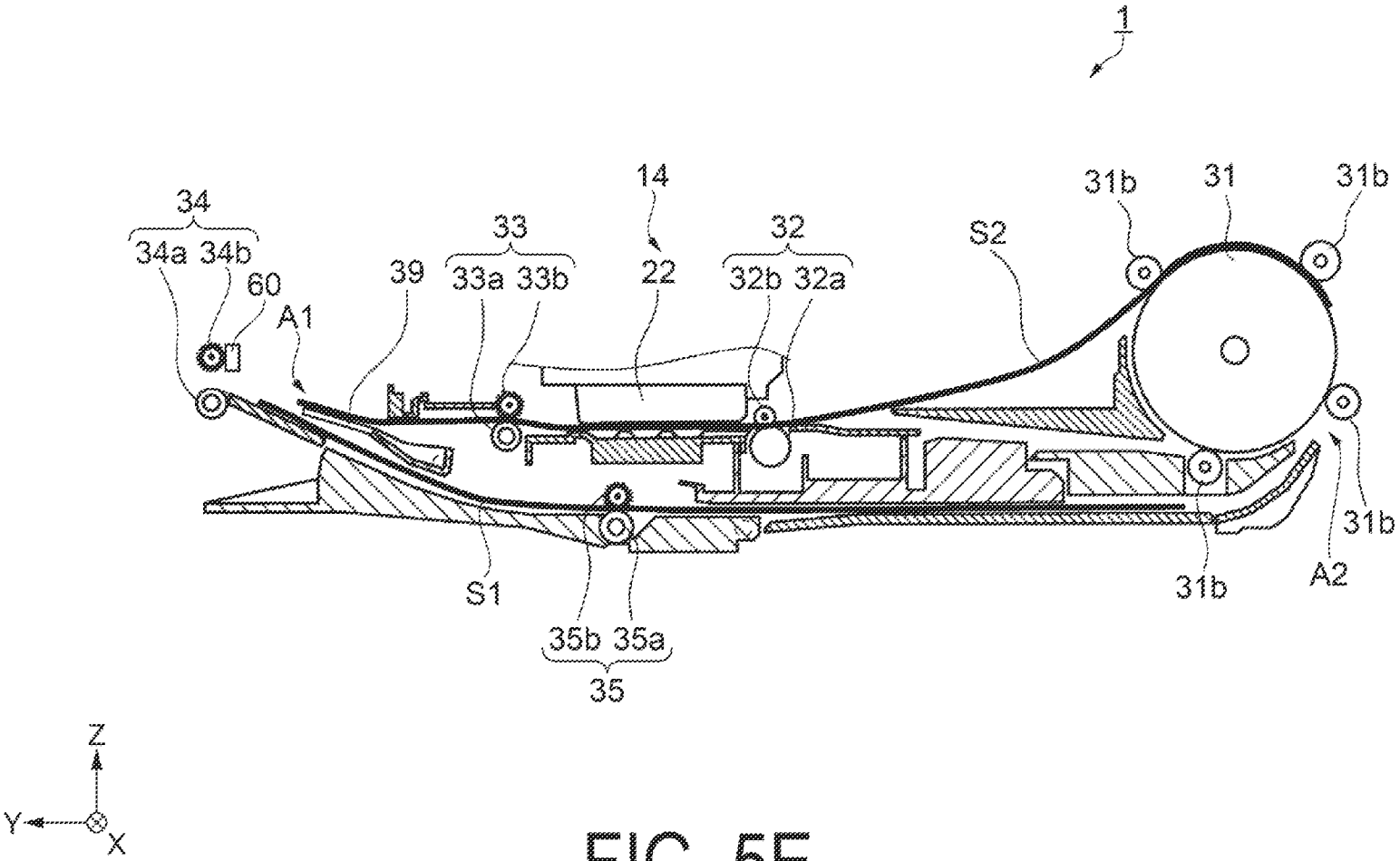
FIG. 5E is a schematic view illustrating the control method of the recording device.

Next, as illustrated in FIG. 5E, when the recording medium S1 deviates from the second discharge roller pair 34, the control unit 100 moves the second discharge roller pair 34 from the sandwiching state to the separated state. Then, the second discharge driving roller 34*a* is rotated in the normal direction.

Note that the recording medium S1 drawn into the second transport path 25 is transported toward the merging position A2 by the relay roller pair 35.

Subsequently, the recording medium S1 is transported in the first transport path 24 with the front and back surfaces being inverted by the first transport roller 31, and is recorded by the recording unit 14. In this way, double-sided printing of the recording medium S1 is performed.

As described above, according to the control method of the recording device 1, in a recording processing period of the recording medium S1, the second discharge roller pair 34 is moved into the separated state, and does not take part in transport of the recording medium S1. In this way, the recording medium S1 is transported by a fixed amount, and the image quality can be improved.

Further, the first discharge roller pair 33 and the second discharge roller pair 34 are driven by different driving sources, and thus a speed of double-sided printing can be increased.

Note that, in the description above, the movement mechanism 60 is driven on the basis of a print job, and the second discharge roller pair 34 is moved between the sandwiching state and the separated state, but the present disclosure is not limited thereto. For example, a sensor that detects presence or absence of the recording medium S may be provided between the head 22 above the first transport path 24 and the first discharge roller pair 33, and the movement mechanism 60 may be driven according to acquisition information of the sensor. Even with this configuration, similar advantages as described above can be obtained.

What is claimed is:

1. A recording device, comprising:

a recording unit configured to perform recording on a recording medium;

a first transport path in which the recording medium is transported in a first direction during recording by the recording unit;

a second transport path that is coupled to the first transport path in a position downstream of the recording unit in the first direction, and in which the recording medium, on which recording was performed by the recording unit, is transported in a second direction different from the first direction in a path different from the first transport path;

a first discharge roller pair disposed in a position upstream in the first direction from a coupling position of the first transport path with the second transport path, and configured to sandwich the recording medium on which recording was performed by the recording unit, and transport the recording medium in the first direction;

a second discharge roller pair disposed in the coupling position or disposed downstream of the coupling position in the first direction, configured to sandwich the recording medium, and apply a transport force in the first direction to the recording medium in the first transport path and a transport force in the second direction to the recording medium in the second transport path, and the second discharge roller pair being formed of a second discharge driving roller and a second discharge driven roller;

a first driving motor configured to drive the first discharge driving roller;

a second driving motor configured to drive the second discharge driving roller; and a movement mechanism configured to move the second discharge roller pair to a sandwiching state where the second discharge driving roller and the second discharge driven roller sandwich the recording medium, and to a separated state where the second discharge driving roller and the second discharge driven roller are separated, wherein the movement mechanism includes:

an eccentric cam, a slide cam configured to interlock with the eccentric cam, and a surface of the slide cam slidable moves in contact with a rotary shaft of the second discharge driven roller, and thus the second discharge driven roller moves to the sandwiching state and the separated state with respect to the second discharge driving roller, and the second discharge roller pair is in the separated state in a part of a period in which the recording medium is transported.

2. The recording device according to claim 1, wherein, in the part of the period, the second discharge roller pair is in the separated state in a period in which recording is performed on the recording medium by the recording unit.

3. The recording device according to claim 2, wherein, after recording on the recording medium by the recording unit ends, the second discharge roller pair moves from the separated state to the sandwiching state, and applies a transport force in the first direction or applies a transport force in the second direction.

4. The recording device according to claim 1, wherein the second discharge roller pair is in the separated state in a period in which the first discharge roller pair applies a transport force in the first direction to the recording medium.

5. The recording device according to claim 4, wherein the second discharge roller pair moves from the separated state to the sandwiching state in a period in which the first discharge roller pair applies a transport force in the first direction to the recording medium.

6. The recording device according to claim 5, wherein the recording unit performs recording on a second recording medium different from the recording medium in a period in which the second discharge roller pair applies a transport force in the second direction to the recording medium.

7. The recording device according to claim 6, wherein the second discharge roller pair moves from the sandwiching state to the separated state in a period in which the first discharge roller pair applies a transport force in the first direction to the second recording medium.

8. The recording device according to claim 1, wherein the eccentric cam is driven by a third driving motor or a solenoid.

* * * * *